US006587567B1

(12) United States Patent
Yamamoto

(10) Patent No.: US 6,587,567 B1
(45) Date of Patent: Jul. 1, 2003

(54) PIEZOELECTRIC ELECTROACOUSTIC TRANSDUCER

(75) Inventor: Kazuaki Yamamoto, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/297,613

(22) PCT Filed: Dec. 5, 1997

(86) PCT No.: PCT/JP97/04453

§ 371 (c)(1),
(2), (4) Date: May 3, 1999

(87) PCT Pub. No.: WO98/31189

PCT Pub. Date: Jul. 16, 1998

(30) Foreign Application Priority Data

Jan. 6, 1997 (JP) ..... 9-000341

(51) Int. Cl.[7] ..... H04R 25/00
(52) U.S. Cl. ..... 381/190; 381/191; 381/431
(58) Field of Search ..... 381/114, 173, 381/190, 152, 191, 431; 310/327, 340; 367/155, 157, 180

(56) References Cited

U.S. PATENT DOCUMENTS 2,242,756 A * 3/1941 Pope ..... 381/190
4,436,648 A * 3/1984 Khanna et al. ..... 381/173
4,969,197 A * 11/1990 Takaya ..... 381/190
5,317,305 A * 5/1994 Campaman ..... 381/345
5,490,220 A * 2/1996 Loeppert ..... 381/173
5,590,908 A * 1/1997 Carr ..... 280/809
5,844,484 A * 12/1998 Fujiuchi et al. ..... 340/572
5,889,871 A * 3/1999 Downs ..... 381/190

FOREIGN PATENT DOCUMENTS

| | | |
|---|---|---|
| JP | 62-109500 | 5/1987 |
| JP | 3-125396 | 12/1991 |
| KR | 90-6323 | 8/1990 |

* cited by examiner

*Primary Examiner*—Duc Nguyen
(74) *Attorney, Agent, or Firm*—Keating & Bennett, LLP

(57) ABSTRACT

In a piezoelectric acoustic transducer as formed by ultrasonically welding first and second resin casing components together while causing a piezoelectric vibration plate 5 to be laid between a first resin casing component 3 with sound release holes 3*c* and a second resin casing component 4, the piezoelectric vibration plate 5 is employed as a specific vibration plate of an approximately rectangular planar shape.

As a result, Obtained is a small-size piezoelectric acoustic transducer capable of reducing damages of a piezoelectric vibration plate even where its resin casing is assembled by ultrasonic welding techniques.

19 Claims, 12 Drawing Sheets

PIEZOELECTRIC ELECTROACOUSTIC TRANSDUCER

TECHNICAL FIELD OF THE INVENTION

The present invention relates to electroacoustic transducers of the piezoelectricity type for use with piezoelectric sounders, piezoelectric speakers, piezoelectric telephone receivers and the like, and more particularly to improvements of the structure of a piezoelectric electroacoustic transducer having a piezoelectric vibration plate housed within a resin casing assembled by ultrasonic welding techniques.

TECHNOLOGICAL BACKGROUND

Conventionally, there have been well known piezoelectric electroacoustic transducers adaptable for use as piezoelectric sounders and piezoelectric speakers. Incidentally, in the piezoelectric electroacoustic transducers, it has been demanded to let them have dielectricity on the surfaces thereof in some applications. To this end, a piezoelectric electroacoustic transducer has been proposed which comes with a piezoelectric vibration plate as housed within the interior of its resin casing.

It should also be admitted that like other types of electronics parts or components, the piezoelectric electroacoustic transducer is also technically required to offer higher heat resistivity or thermal robustness. Accordingly, it is required to constitute the resin casing from synthetic resin materials with enhanced heat resistivity. However, such heat resistivity-enhanced synthetic resin materials are generally deficient in adhesionability, which would result in difficulty of employing a method of joining a plurality of resin casings together by bonding or adhesion techniques.

On the other hand, in the piezoelectric electroacoustic transducers, it has also been demanded to attain down-sizing and thickness reduction; in view of accommodating such demand, it is also difficult to provide special shapes and structures which require a plurality of resin casing components engaged with one another.

Then, as the method for enabling facilitation of down-sizing and thickness reduction while simultaneously enabling arrangement by use of synthetic resin materials with enhanced heat resistivity, a piezoelectric electroacoustic transducer has been proposed which includes its resin casing formed by causing two resin casing components to be adhered or bonded together by ultrasonic welding techniques for disposing a piezoelectric vibration plate within resultant resin casing (Published Unexamined Japanese Patent Application, or PUJPA, Nos. 62-109499 and 62-109500).

More specifically, the approach as disclosed in PUJPA No.62-109499 is such that a pair of casing components are subjected to ultrasonic welding while causing a circular or disk-like piezoelectric vibration plate to be held between the resin casing components with certain parts which hold the piezoelectric vibration plate therebetween being put into chosen liquid.

Alternatively, the approach disclosed in PUJPA No.62-109500 is such that while letting a disk-like piezoelectric vibration plate be sandwiched between a pair of resin casing components and at the same time causing the piezoelectric vibration plate to be supported by an elastic or resilient member for suppression of vibrations of the piezoelectric vibration plate, the resin casing components are ultrasonically welded at specific portions different from those portions whereat the piezoelectric vibration plate is sandwiched for suspension.

Ultrasonic welding is a method used in joining or bonding together certain synthetic resin materials with enhanced heat resistivity as stated supra; the same is also adaptable for use in reducing size and thickness because of its practicability without having to form any special engaging structures for such casing components.

However, with the ultrasonic welding, it can happen during welding that the disk-like piezoelectric vibration plate is self-destructible due to transmission of ultrasonic vibrations to the piezoelectric vibration plate side. Accordingly, in PUJPA No.62-109499, the piezoelectric vibration plate and parts of the resin casing components holding the piezoelectric vibration plate therebetween are fully put into chosen liquid while ultrasonically welding the resin casing components together at portions outside the liquid thereby eliminating occurrence of destruction of the piezoelectric vibration plate. Alternatively, in PUJPA No.62-109500, the disk-like piezoelectric vibration plate is forced to make contact with an associative elastic member for effectuation of ultrasonic welding while suppressing vibrations of the piezoelectric vibration plate in the way discussed previously.

In other words, while junction of the resin casing components using prior known ultrasonic welding techniques may advantageously serve to enable use of heat resistivity-excellent resin materials and also be suitable for facilitation of down-sizing and thickness reduction, such advantages do not come without accompanying a serious penalty of the need for time-consuming and troublesome works stated supra in order to prevent destruction of the piezoelectric vibration plate due to ultrasonic vibration transmission to the piezoelectric vibration plate.

It is therefore an object of the present invention to provide a piezoelectric electroacoustic transducer employing a resin casing structure essentially consisting of a plurality of resin casing components joined together by ultrasonic welding techniques with capability of easy assembly without the need for any complicated works such as putting into liquid certain part including the piezoelectric vibration plate and dumping vibration by forcing the piezoelectric vibration plate to come into direct contact with elastic or resilient members.

DISCLOSURE OF THE INVENTION

A piezoelectric electroacoustic transducer in accordance with the present invention as set forth in claim 1 is such that the piezoelectric electroacoustic transducer includes a piezoelectric vibration plate as housed in a casing structure essentially consisting of a plurality of resin casing parts or components bonded together by ultrasonic welding techniques, featured by employing a piezoelectric vibration plate which substantially resembles a rectangle in planar shape.

One advantage of the prescribed piezoelectric electroacoustic transducer lies in capability of suppressing destruction of the piezoelectric vibration plate because of the fact that the piezoelectric vibration plate is specifically designed to have a substantially rectangular planar shape, which in turn prevents or at least greatly suppresses vibration occurring during ultrasonic welding from being locally transferred to or "converged" at the center of the piezoelectric vibration plate, as will become apparent from a later description of some preferred embodiments of the invention.

More specifically, the aforesaid piezoelectric vibration plate is held by a plurality of resin casing components at the periphery thereof.

Preferably, the plurality of resin casing components are comprised of first and second resin casing components which are also arranged to substantially resemble a rectangle in planar shape, which in turn allows the piezoelectric vibration plate and resin casing components to be similar in planar shape to each other, thereby enabling facilitation of down-sizing or miniaturization of the piezoelectric electroacoustic transducer.

Additionally, in accordance with one specific aspect of the present invention, the piezoelectric vibration plate has a metal plate, a piezoelectric ceramic layer adhered to the metal plate, and electrodes formed on the opposite principal surfaces of the piezoelectric ceramic layer, wherein at least the metal plate is of a substantially rectangular planar shape. In this case the piezoelectric ceramic layer may be arranged to differ in planar shape from the metal plate—that is, the layer may be of any other shapes such as a circular shape—or alternatively may be designed to have a rectangular planar shape in a way similar to that of the metal plate.

In accordance with a more limitative aspect of the present invention, the metal plate is provided as a metal plate which may function also as a corresponding associative terminal—say, "dual functional" or "terminal cofunctional" metalplate. In this case a lead terminal is further provided which is connected to specific one of the electrodes formed on the piezoelectric ceramic layer which one does not make contact with the metal plate while causing the terminal-cofunctional metal plate and the lead terminal to be externally elongated from the casing.

In accordance with another limitative aspect of the present invention, first and second lead members are in contact with the metal plate and the specific electrode electrically separated from the metal plate, respectively. These first and second lead members are to be externally taken out of the casing. The lead members may be constituted from either certain lead terminal made of metal plates or those lead wires with resiliency or flexibility.

BEST FORM FOR PRACTICING THE INVENTION

The principles of the present invention will become apparent from the following description of several preferred embodiments of the invention with reference to the figures of accompanying drawings although the invention should not exclusively be limited to such embodiments.

Figure 1:
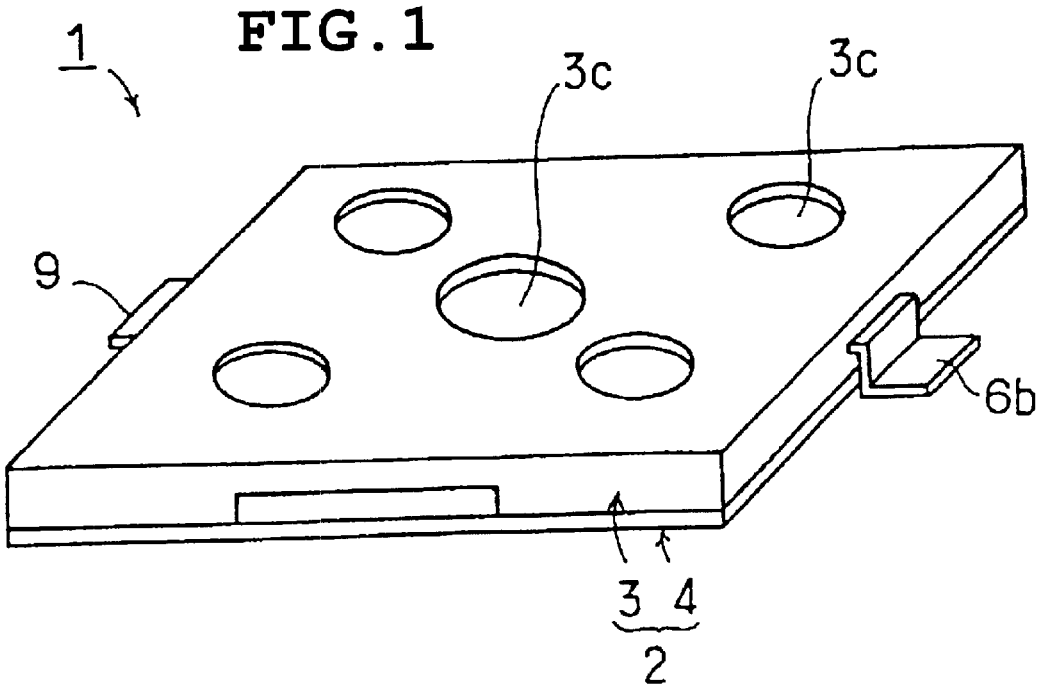
FIG. 1 is a perspective diagram showing a piezoelectric electroacoustic transducer in accordance with one embodiment of the present invention.
Figure 2:
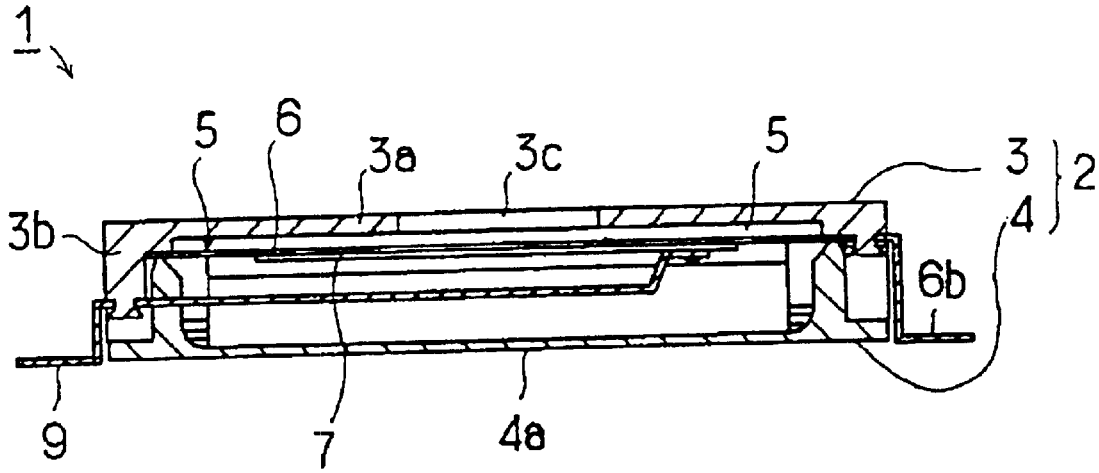
FIG. 2 is a longitudinal cross-sectional diagram of the piezoelectric electroacoustic transducer shown in FIG. 1.
Figure 3A:
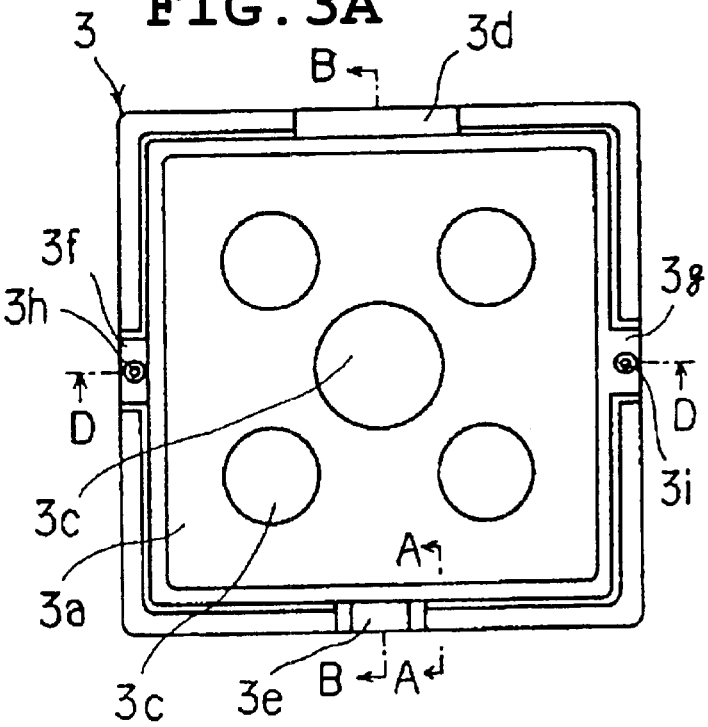
FIGS. 3(*a*) to (*d*) are depictions showing a first resin casing component for use in the embodiment, wherein FIG. 3(*a*) is a bottom view, FIG. 3(*b*) is a cross-section along line B—B of FIG. 3(*a*), FIG. 3(*c*) is a plan view, and FIG. 3(*d*) is a cross-section along line D—D of FIG. 3(*a*).
Figure 3B:
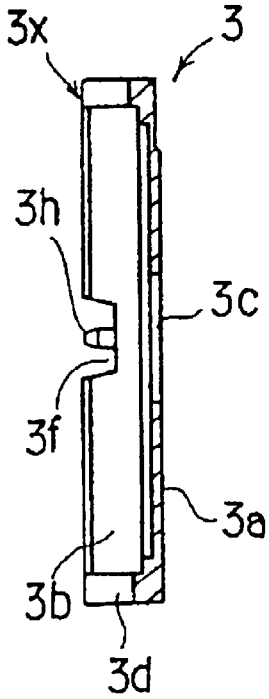
Figure 3C:
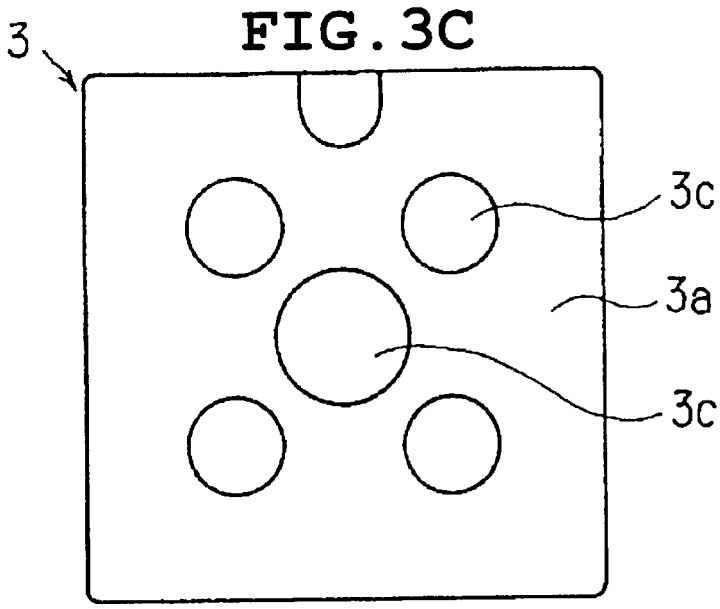
Figure 3D:
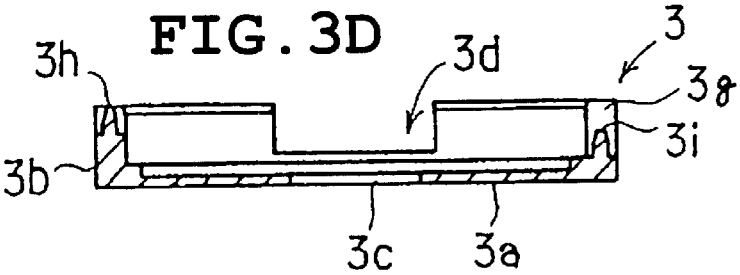

FIG. 1 is a diagram showing a perspective view of a piezoelectric electroacoustic transducer in accordance with one embodiment of the present invention whereas FIG. 2 illustrates a cross-sectional view thereof.

A piezoelectric electroacoustic transducer 1 is constituted using a resin casing structure 2. The resin casing 2 essentially consists of a first resin casing component 3 and a second resin casing component 4. As will be described later, the resin casing components 3, 4 are joined or bonded together by ultrasonic welding techniques so that rigid junction is attainable with ease even where these are made of synthetic resin materials with enhanced heat resistivity.

The first resin casing component 3 has a rectangular top or "roof" plate 3*a* and a side wall 3*b* extending from the periphery of roof plate 3*a* toward the side of second resin casing component 4. The roof plate 3*a* has a plurality of sound release holes 3*c* which are so formed as to extend through the roof plate 3*a*. The shape and number of such sound release holes 3*c* should not exclusively be limited to the exemplary structure as depicted herein. In other words, any presently available sound release holes with different shapes may be employed therein.

A detail of the casing component 3 is shown in FIGS. 3(*a*) to 3(*d*). As apparent from FIG. 3, cut-away portions 3*d*, 3*e* are formed at two opposite sides of the side wall 3*b*, respectively. One cutaway 3*d* is an opening which opens downward in FIG. 2; this cutaway 3*d* is used for constitution of a sound release hole in the side plane of the casing.

Additionally, cutaway portions 3*f*, 3*g* are centrally formed in the side wall 3*b* at the remaining two opposite sides thereof which are different from those whereat the cutaways 3*d*, 3*e* are provided, while forming projected portions 3*h*, 3*i* at respective cutaways 3*f*, 3*g*. These projections 3*h*, 3*i* are formed in order to support a piezoelectric vibration plate and its associated terminals as will be described later. Note in this embodiment that the projection 3*i* is less in height than projection 3*h*. Note also that cutaway 3*e* is merely for stable storage of a gate block as will be used during machining of the casing structure and thus is not essential to the present invention.

Figure 4:
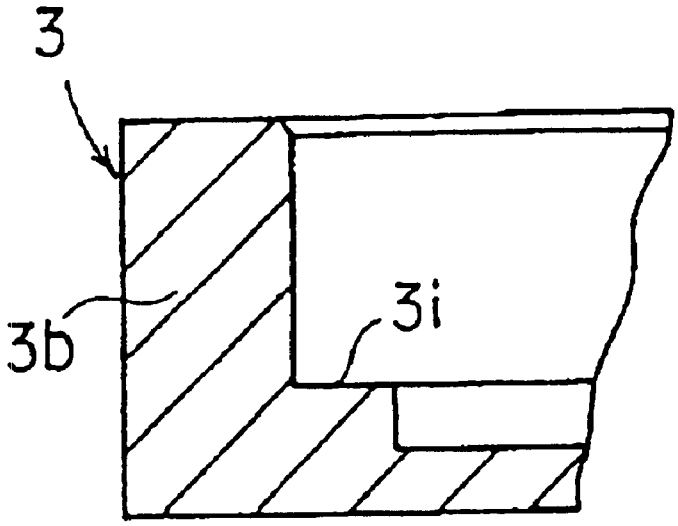
FIG. 4 is an enlarged cross-sectional view of part along line A—A of FIG. 3(*a*).
Figure 5A:
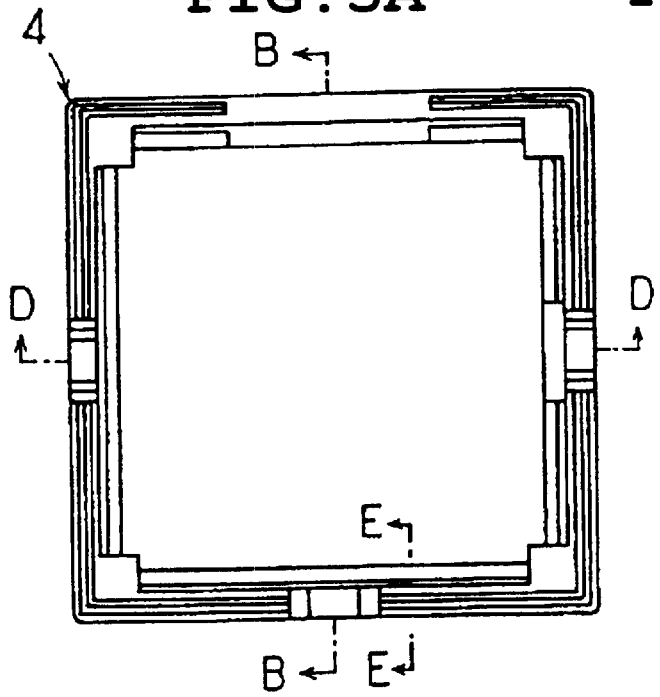
FIGS. 5(*a*) to (*d*) are illustrations showing a second resin casing component for use in one embodiment of the invention, wherein FIG. 5(*a*) is a plan view, FIG. 5(*b*) is a cross-section along line B—B of FIG. 5(*a*), FIG. 5(*c*) is a bottom view, and FIG. 5(*d*) is a cross-section along line D—D of FIG. 5(*a*).
Figure 5B:
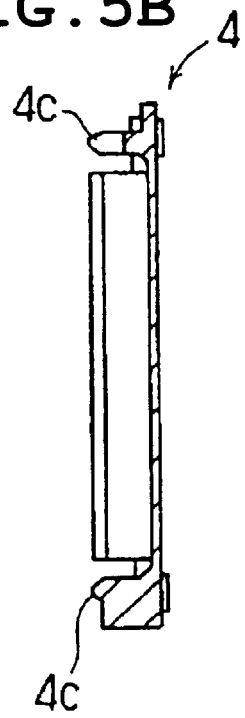
Figure 5C:
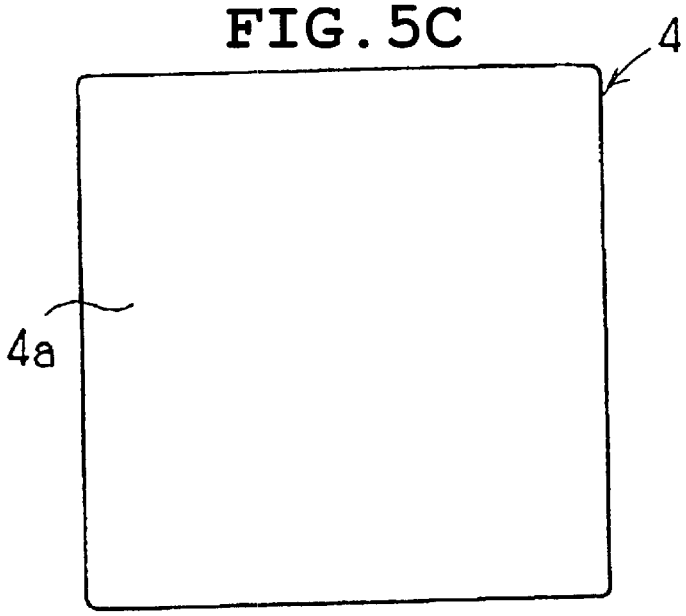
Figure 5D:
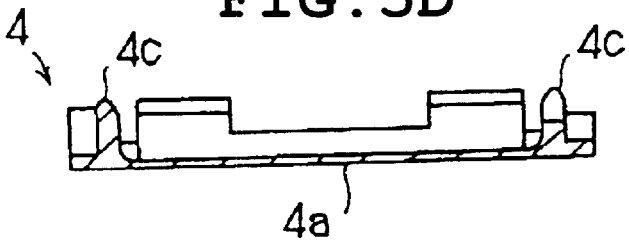

Also, as apparent from viewing the illustration of FIG. 4 which shows a cross-sectional view of part taken along line A—A of FIG. 3(*a*), a stair-step section 3*j* is formed at selected portions inside the side wall 3*b* other than those portions with the cutaways 3*d*–3*g* being formed.

A detail of the second resin casing component 4 of FIG. 2 will be explained in conjunction with FIGS. 5 and 6.

As shown in FIGS. 5(*a*) and 5(*b*), the second resin casing component 4 is made of a chosen synthetic resin material of a substantially rectangular planar shape. The resin casing component 4 has ribs 4*c* each of which is elongated in parallel to the outer peripheral edge at a location near an external peripheral edge of a bottom plate 4*a* resembling a rectangle in shape. Each rib 4*c* is of a pin-point shape at the distal end thereof; this rib 4*c* is provided for rigid support of a piezoelectric vibration plate discussed infra.

Figure 6:
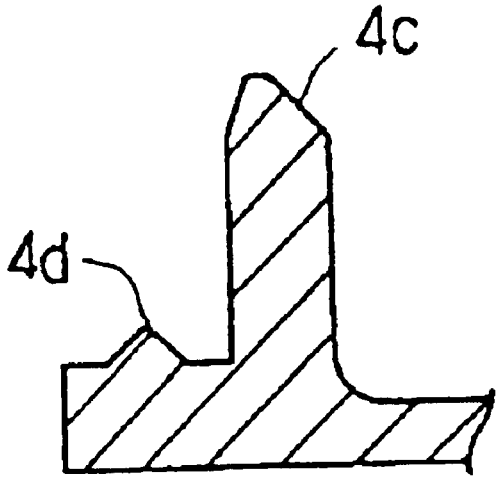
FIG. 6 is a cross-sectional view of part along line E—E of FIG. 5(*a*).

On the other hand, as apparent from FIG. 6 which shows an enlarged cross-sectional view of part as taken along line E—E of FIG. 5(*a*), a further rib 4*d* is formed at a selected position outside the rib 4*c* on each side so as to extend in parallel to its corresponding external peripheral edge. The rib 4*d* is equivalent to a portion which is to be ultrasonically welded to an outer flat edge portion 3x of the resin casing component 3.

Figure 7:
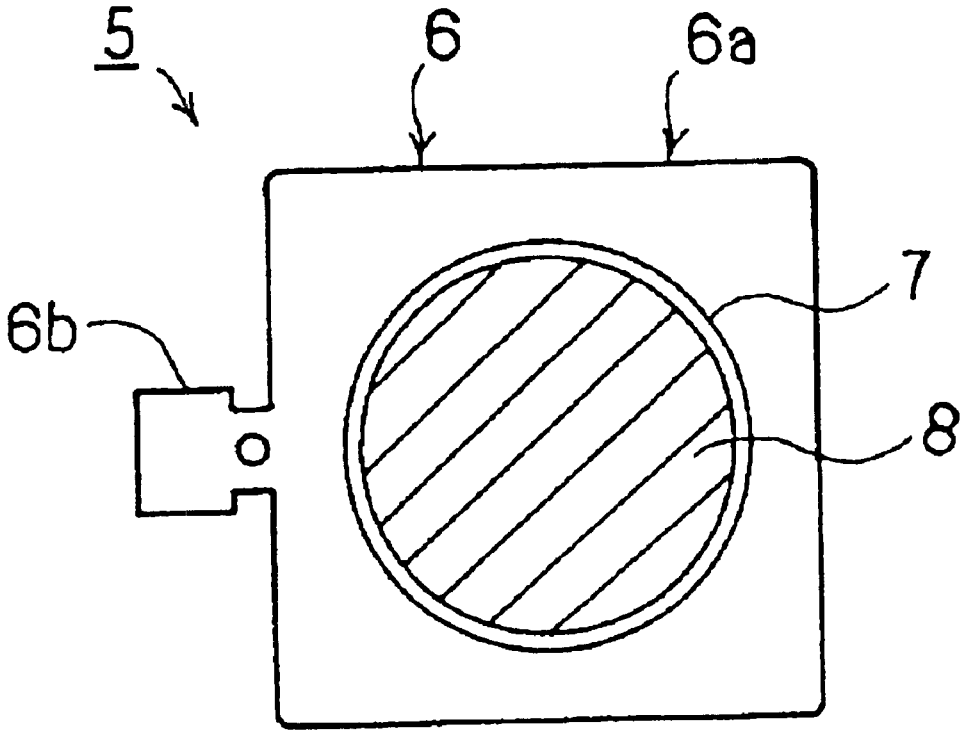
FIG. 7 is a diagram showing a plan view of a piezoelectric vibration plate as used in one embodiment of the invention.

Turning back to FIG. 2, a piezoelectric vibration plate 5 is laid or "sandwiched" between the first and second resin casing components 3, 4. As shown in a bottom view presented in FIG. 7, the piezoelectric vibration plate 5 has a structure in which a piezoelectric ceramic layer 7 is adhered onto the lower surface of a metal plate 6 with electrodes 8 being formed on the opposite major surface of the piezoelectric ceramic layer 7.

The metal plate 6 has a metal plate main body 6*a* of a substantially rectangular planar shape on which the piezoelectric ceramic layer 7 is formed, and a terminal section 6*b* elongated from the center of one side of such metal plate main body 6*a*. More specifically, the metal plate 6 is designed as a dual-functional or "terminal-cofunctional" metal plate with its terminal section 6*b* extending externally from the casing 2 as shown in FIGS. 1 and 2.

The piezoelectric ceramic layer 7 is comprised of appropriate piezoelectric ceramics such as lead zirconate titanate-based piezoelectric ceramics; in this embodiment, its planar shape is designed to resemble a circle or disk. Note here that the piezoelectric ceramic layer 7 may alternatively be designed so that its planar shape is any one of other shapes, such as a rectangle or the like.

With regard to the piezoelectric ceramic layer 7, this is structured by laminating on the metal plate 6 a piezoelectric ceramic plate that has been baked in advance. In lieu of such lamination, the layer may be provided by directly forming a piezoelectric ceramic layer on the metal layer 6 and thereafter performing polarization process. In this case, the electrode may be separately formed on certain side which does not make contact with the metal plate of the piezoelectric ceramic layer.

Figure 8:
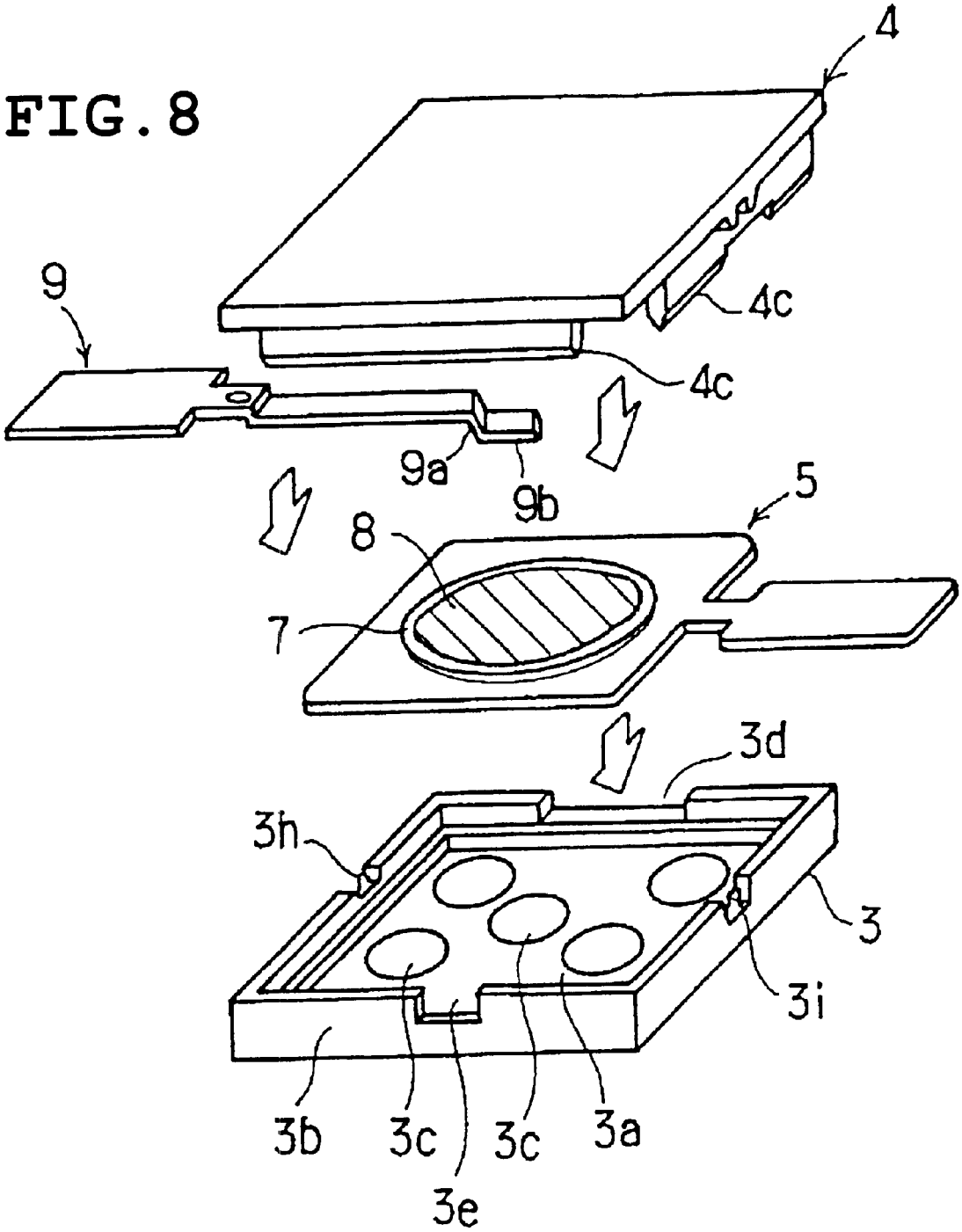
FIG. 8 is a diagram showing a perspective exploded view of a piezoelectric electroacoustic transducer for explanation of assembly procedure thereof.

Assembly of the piezoelectric electroacoustic transducer 1 embodying the invention is carried out in a way shown in FIG. 8 as an exploded diagram for explanation. More specifically, the first and second resin casing components 3, 4 are engaged with each other while allowing the piezoelectric vibration plate 5 and metal terminal 9 to be held between these components. Note in FIG. 8 that the piezoelectric vibration plate 5 comes with the ceramic layer 7 and electrode 8 as formed on its top surface. Concerning the metal terminal 9, any appropriate structure may be employed therefor as far as it is ensured that the distal end thereof is firmly brought into contact with the electrode 8. In this embodiment this terminal is arranged by formation of a bent portion 9*a* at its distal end in a manner such that a contact section 9*b* is contacted with the electrode 8 with certain elasticity or resiliency. In this case also, chosen adhesive such as solders, conductive adhesive or the like may be employed to attain more rigid contact or junction therebetween.

After completion of assembling in the way described above, the resin casing components 3, 4 are contacted and bonded with each other by ultrasonic welding techniques. This junction due to ultrasonic welding is effectuated in a way such that the outer flat edge portion 3x of resin casing component 3 stated supra is ultrasonically welded to the rib 4*d* of resin casing component 4.

One significant feature of the piezoelectric electroacoustic transducer 1 in accordance with this embodiment is that the piezoelectric ceramic layer 7 of piezoelectric vibration plate 5 is hardly destructible even when this ultrasonic welding is performed. This will be explained with reference to FIGS. 9(*a*) and 9(*b*) below.

Figure 9A:
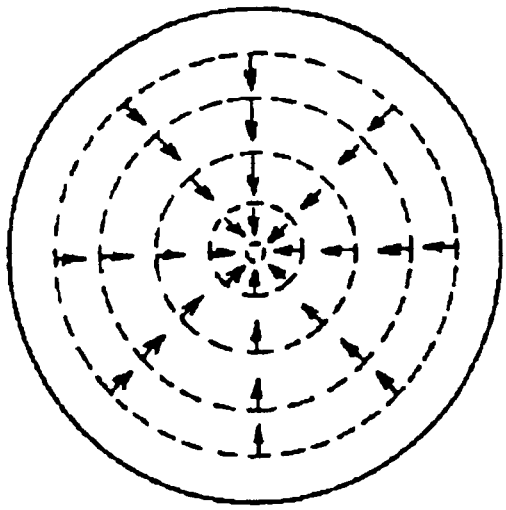
FIG. 9(*a*) is a depiction showing a plan view of a model for explanation of the state in which vibration is transmitted in a disk-shaped piezoelectric vibration plate, and FIG. 9(*b*) is a pictorial representation showing a plan view for explanation of the transmission state in a case where vibration is applied from the periphery of a rectangular piezoelectric vibration plate.
Figure 9B:
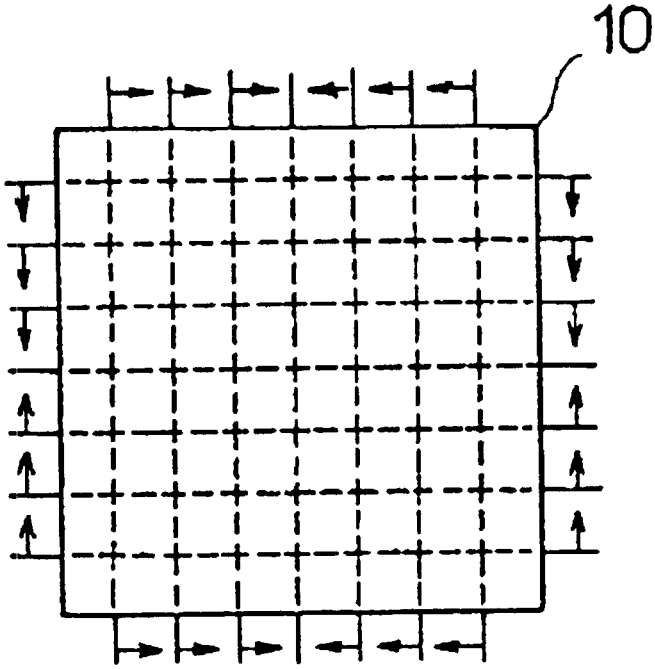

With one typical prior art piezoelectric electroacoustic transducer, its piezoelectric vibration plate was designed to have a disk-like shape. Accordingly, as shown by arrows in FIG. 9(*a*), the piezoelectric ceramics can be destroyed due to local concentration of ultrasonic vibration toward the center of such disk when transferred from the outside. In contrast, as shown in FIG. 9(*b*), with the piezoelectric vibration plate 10 having a rectangular planar shape, even upon transmission of ultrasonic vibration to its periphery, such ultrasonic vibration is forced to transfer in a direction parallel to each side of the rectangular piezoelectric vibration plate 10. Accordingly, vibration components may disperse or cancel one another at outer peripheral sections of the piezoelectric vibration plate 10 thus rendering the piezoelectric ceramics robust against destructibility.

As a consequence, in the piezoelectric electroacoustic transducer 1 of this embodiment, the piezoelectric ceramic layer 7 is hardly destructible even where ultrasonic vibration might be transferred to the piezoelectric vibration plate 5 during ultrasonic welding because of the fact that the piezoelectric vibration plate 5 is specifically designed to have a rectangular planar shape or other shapes as equivalent thereto.

An advantage of such rectangular shape design scheme for the piezoelectric vibration plate will be explained based on some practical experimental examples as follows.

As the piezoelectric electroacoustic transducer of the embodiment shown in FIG. 1, a structure was prepared which includes a casing 2 designed to have a square shape measuring 16 mm by 16 mm and a piezoelectric vibration plate 5 formed into a square shape of 14 mm by 14 mm. For comparison, a planarly circular piezoelectric electroacoustic transducer measuring 16 mm in diameter was also prepared with the prior art structure which has a piezoelectric vibration plate of the circular planar shape of 14-mm diameter. With certain parameters as to ultrasonic welding and piezoelectric vibration plate support structure being identical among them, experimentation was done by ultrasonic welding for evaluation of the degree of destructibility of piezoelectric vibration plate and resin casing.

For any one of the embodiment and prior art, twenty piezoelectric electroacoustic transducer test samples ware prepared and then subjected to ultrasonic welding for assembly under an application pressure of 3 kg at 19 kHz and 300W for 0.3 second. The result is such that the embodiment piezoelectric electroacoustic transducer were completely free from destruction at both piezoelectric ceramic layer and casing whereas the prior art piezoelectric electroacoustic transducer was 35% in rate of breakage of piezoelectric ceramic layer and 10% in casing breakage rate.

Accordingly, it has been experimentally verified and demonstrated that in the embodiment piezoelectric electroacoustic transducer, designing its piezoelectric vibration plate in a substantially rectangular shape may render the piezoelectric vibration plate and casing hardly destructible even when assembled by ultrasonic welding techniques.

Figure 10A:
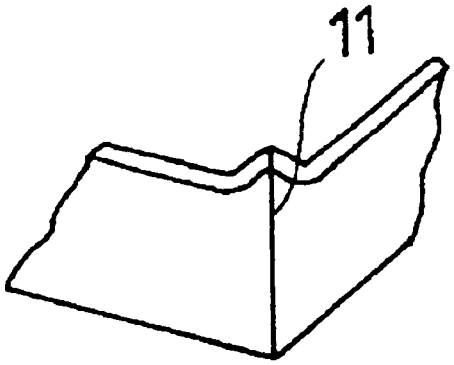
FIG. 10(*a*) is a partially cut-away perspective diagram for explanation of a projected portion occurring at a corner section of resin casing during machining thereof, and FIG. 10(*b*) is a partly cut-away perspective diagram for explanation of the structure having a cut-away portion for elimination of any projected portions otherwise occurring at corner sections during machining.
Figure 10B:
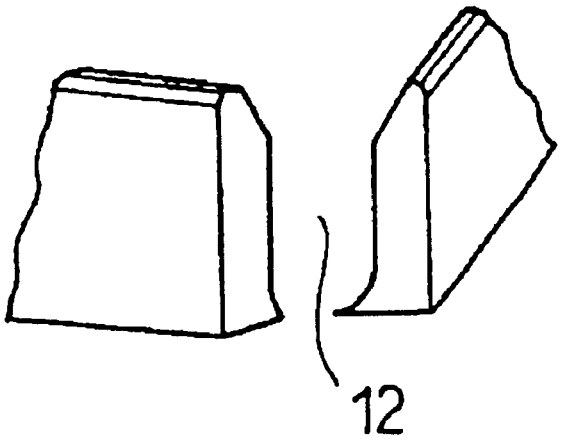

It should be noted that where a substantially rectangular resin casing is machined such as in the case of the first and second casing components 3, 4, it occasionally happened that an inwardly projected raised portion or "protuberance" 11 could be formed between side walls at a corner section as shown in FIG. 10(*a*) causing finished products to decrease in characteristic and mechanical strength. One preferable approach to avoid this is to form a cut-away portion 12 on the side wall section at each corner section of the resin casing components 3, 4 as shown in FIG. 10(*b*) thereby to eliminate a decrease in characteristic and a degradation of mechanical strength otherwise occurring due to the presence of the protuberance 11 mentioned supra. More preferably, the cutaway 12 is formed at the second resin casing component 4 which is to be engaged by insertion into the first resin casing component 3. With such an arrangement, the presence of such cutaway 12 will become less visible or eye-catchable in the outer appearance thereof.

(Modification)

Figure 11:
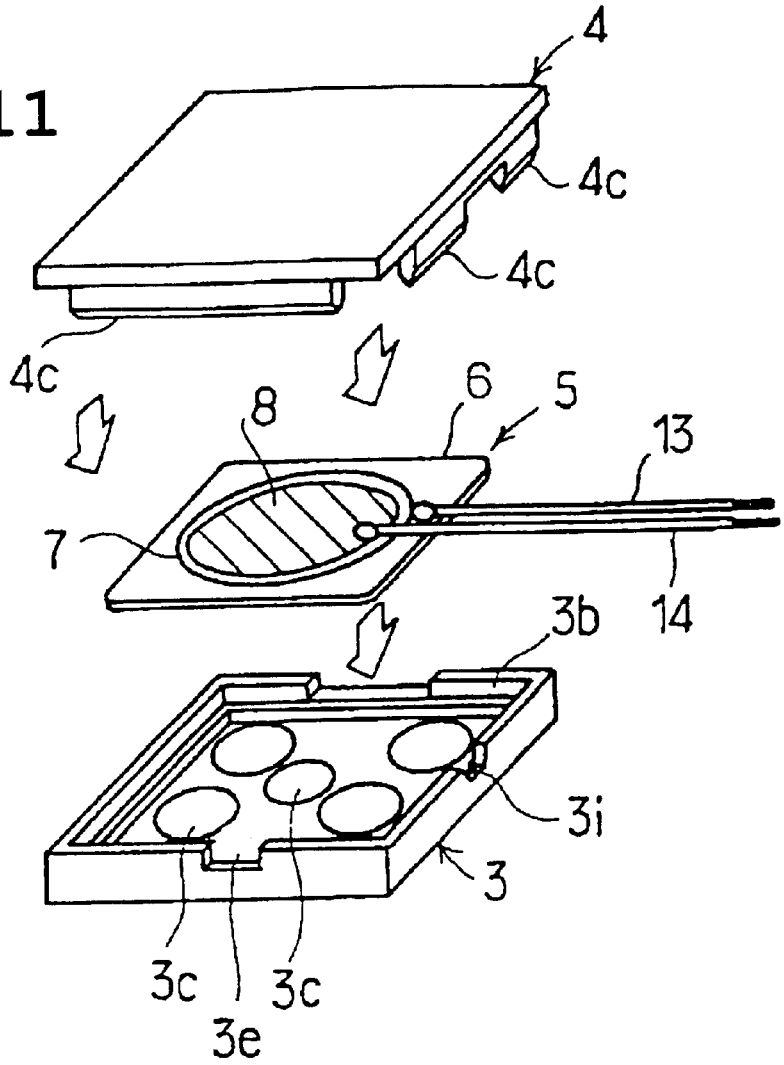
FIG. 11 is an exploded diagram for explanation of one modification of the piezoelectric electroacoustic transducer embodying the present invention.
Figure 12:
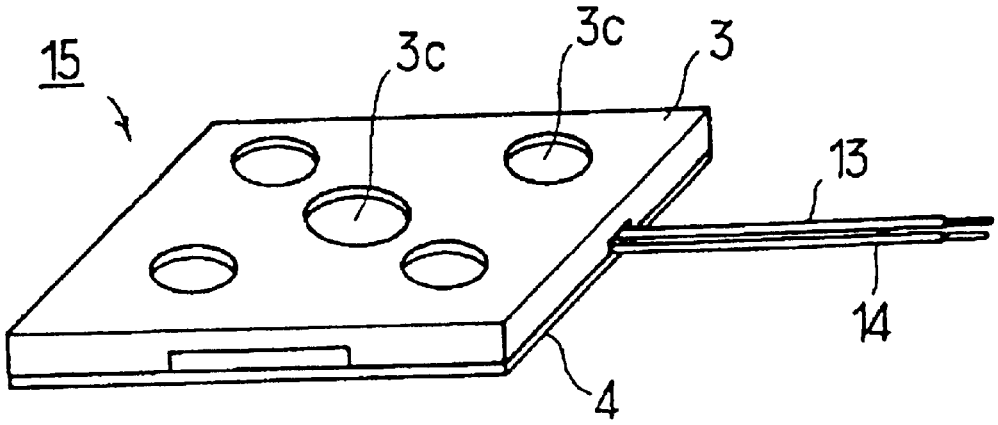
FIG. 12 is a perspective diagram showing another modification of the piezoelectric electroacoustic transducer in accordance with the present invention.

Although the piezoelectric electroacoustic transducer shown in FIGS. 1 and 2 is arranged such that the metal plate 6 of the piezoelectric vibration plate 5 is the dual functional or "terminal-cofunctional" metal plate which may act also as one of associated metal terminals, the present invention should not exclusively be limited to such terminal-cofunctional metal plate structure with respect to the metal plate 6 of piezoelectric vibration plate 5. More specifically, as shown in FIG. 11, the piezoelectric vibration plate 5 may alternatively be designed using a substantially rectangular metal plate 6; if this is the case, a first lead wire 13 is in contact with the metal plate 6 whereas a second lead wire 14 is contacted with the electrode 8 as formed on the piezoelectric ceramic layer 7 for external extension from the casing. In this way, as shown in FIG. 12, a piezoelectric electroacoustic transducer 15 may be provided with the first and second lead wires 13, 14 extending externally toward outside of the casing.

It should be noted that the piezoelectric electroacoustic transducer 15 is similar in structure to the piezoelectric electroacoustic transducer 1 of the embodiment shown in FIG. 1 with the metal plate 6 being modified in shape and with the first and second lead wires 13, 14 being additionally employed. Accordingly, it becomes possible to let the piezoelectric ceramic layer 7 be hardly destructible even when the resin casing components 3, 4 are joined and bonded together by ultrasonic welding techniques, in a manner similar to that of the piezoelectric electroacoustic transducer 1 stated supra.

(Another Modification)

While it is important in cases where the piezoelectric vibration plate is of the substantially rectangular shape to form the metal plate 5 into a substantially rectangular shape, the first and second resin casing components may alternatively be configured to have any shape other than such approximately rectangular shape. It will be preferable, however, to design the resin casing components also in the appropriately rectangular planar shape because of the fact that this may result in the piezoelectric electroacoustic transducer being miniaturized as a whole when this transducer makes use of its piezoelectric vibration plate with such substantially rectangular planar shape.

Figure 13A:
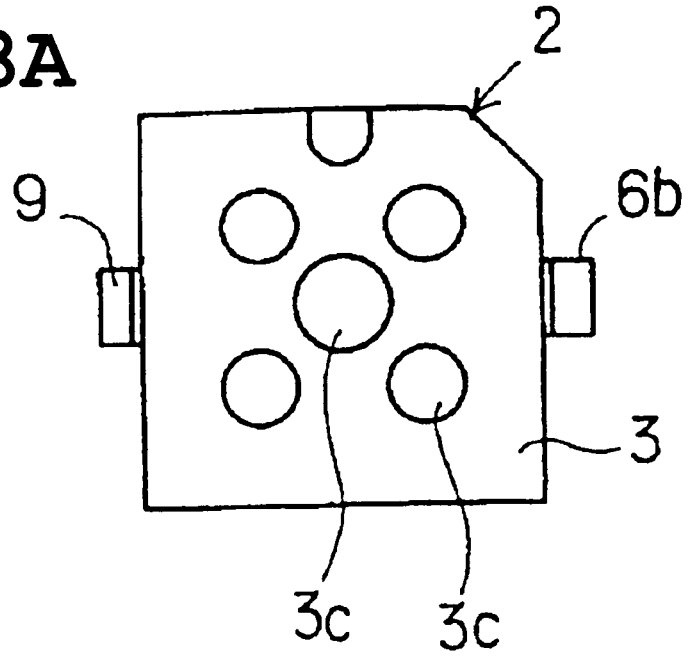
FIG. 13(*a*) and FIG. 13(*b*) are diagrams showing plan views of further modifications for explanation thereof, which are arranged so that the piezoelectric vibration plate and resin casing are each of a substantially rectangular shape having a cut-away portion at its corner section.
Figure 13B:
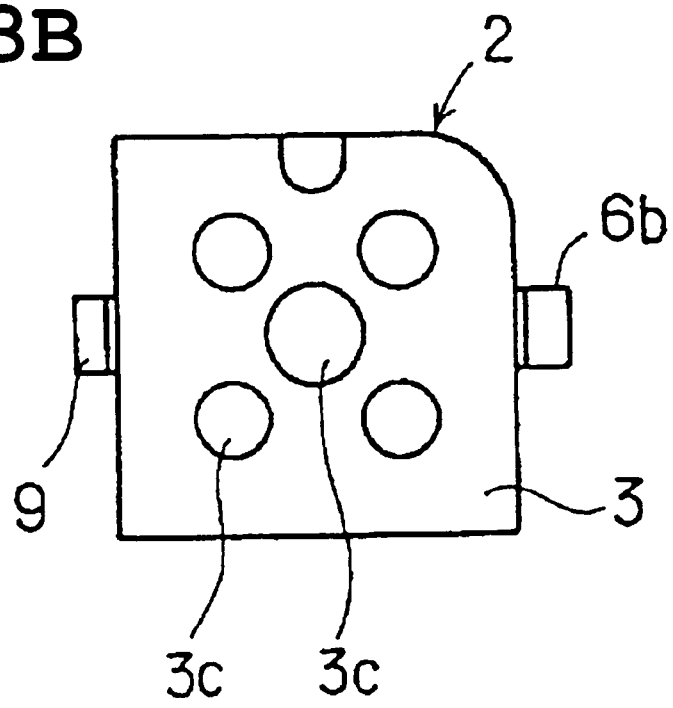

Furthermore, as shown in FIGS. 13(*a*) and 13(*b*), the casing 2 may be designed into a substantially rectangular shape with its corner section being partly cut away.

Figure 14A:
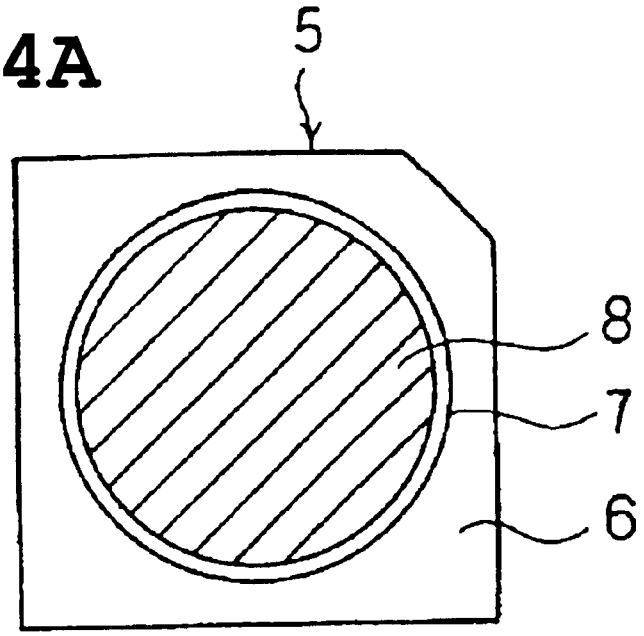
FIG. 14(*a*) and FIG. 14(*b*) are diagrams each showing a planar shape of a piezoelectric vibration plate for use with the piezoelectric acoustic transducer shown in FIG. 13 for explanation thereof.
Figure 14B:
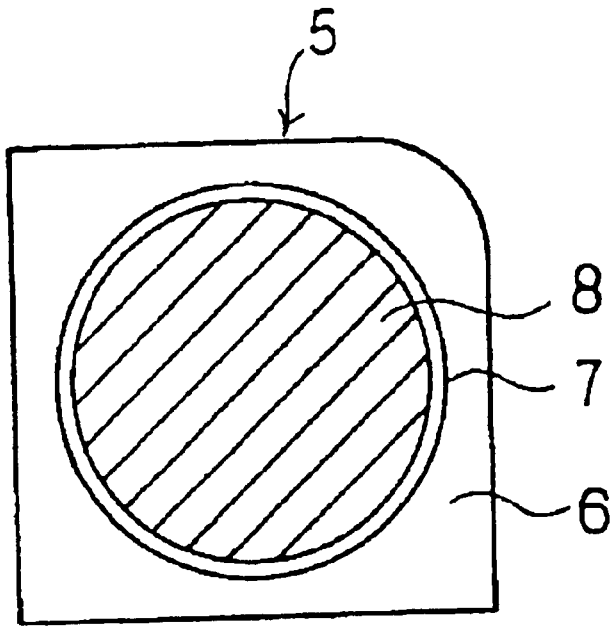

A principal feature of the piezoelectric electroacoustic transducers in accordance with the present invention lies in that the piezoelectric vibration plate is specifically designed in a substantially rectangular shape. Note here that the term "rectangular" should not exclusively be limited in meaning to those rectangles such as exact squares, elongated rectangles and the like and may also refer to any equivalents thereto; by way of example, as shown in FIGS. 14(*a*) and 14(*b*), the metal plate 6 of piezoelectric vibration plate 5 may be modified in such a way that its corner section is partly cut away along a slanted straight line or is cut to be rounded so as to suit metal plate 6 to the casing 2 shown in FIGS. 13(*a*) and 13(*b*). In other words, the piezoelectric vibration plate 5 may also be designed in approximately rectangular shapes with more than one cutaway portion at its corner sections.

Figure 15A:
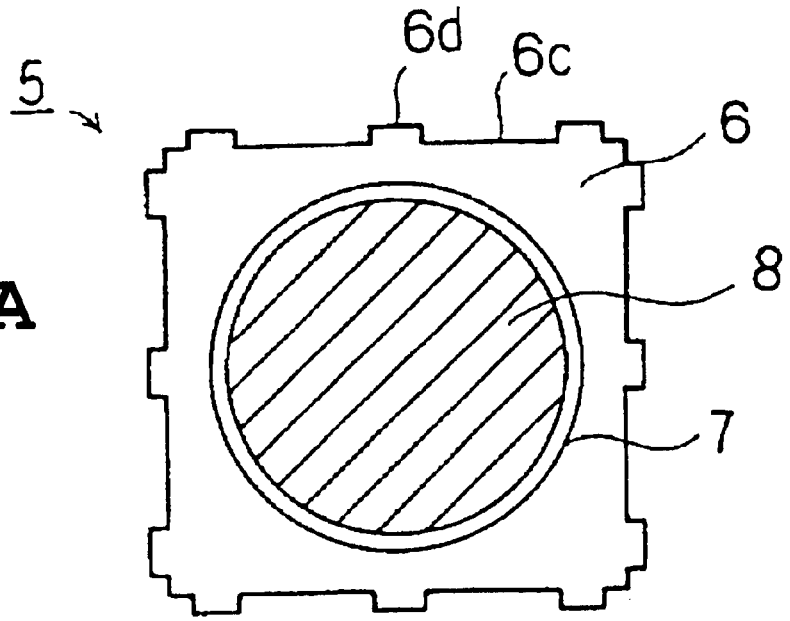
FIG. 15(*a*) and FIG. 15(*b*) are diagrams each showing a further modification of the planar shape of piezoelectric vibration plate for use in the present invention for explanation thereof.
Figure 15B:
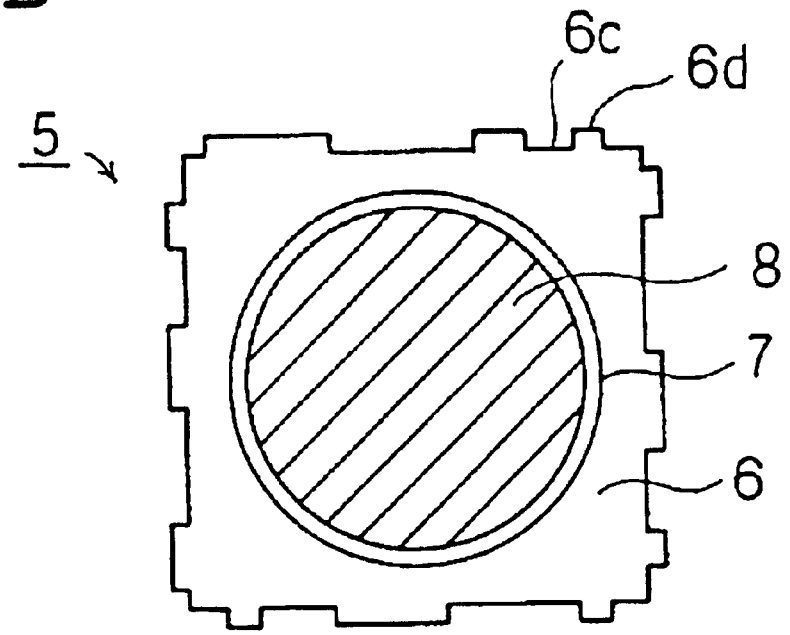

Additionally, as shown in FIGS. 15(*a*) and 15(*b*), the metal plate 6 constituting the piezoelectric vibration plate 5 may also be those having random configurations at the outer peripheral edges thereof. Although in FIGS. 15(*a*) and 15(*b*) concave portions 6*c* and projections 6*d* are formed using a combination of several straight line segments, these may alternatively be formed by use of an ensemble of curved line segments.

Furthermore, the present inventor's experimentation reveals that letting the ratio of long and short sides of a rectangle of the aforesaid piezoelectric vibration plate fall within a carefully selected range of—preferably, from 0.3 to 0.1-IS practicable in view of an electroacoustic transducer.

Application for Industry

According to the present invention, regardless of the fact that the casing is constructed from a plurality of resin casing components as ultrasonically welded together into an integral enclosure, even where vibration during ultrasonic welding is transferred to the piezoelectric vibration plate, such vibration is hardly transmitted to the center of the piezoelectric vibration plate because the piezoelectric vibration plate is designed in a substantially rectangular planar shape, thus enabling successful elimination or at least great suppression of the risk of destructibility of the piezoelectric vibration plate.

Consequently, it is no longer required during ultrasonic welding to carry out troublesome works for putting the piezoelectric vibration plate into liquid and works for damping the piezoelectric vibration plate by use of elastic or resilient members enabling the piezoelectric electroacoustic transducer to be much easily assembled as compared to the prior art methods while simultaneously making it possible to provide an intended high heat-resistance piezoelectric electroacoustic transducer by use of synthetic resin with enhanced heat resistivity. Further, since no engagement structures are required for the resin casing components, it becomes also possible to readily accommodate the requirements for down-sizing and thickness reduction of piezoelectric electroacoustic transducers.

When the first and second resin casing components are specifically arranged to have a substantially rectangular planar shape, it is possible to design the shape of the first and second resin casing components in conformity with the shape of the piezoelectric vibration plate, which in turn enables accomplishment of further miniaturization of the piezoelectric electroacoustic transducer.

When the piezoelectric vibration plate has a metal plate, a piezoelectric ceramic layer, and an electrode(s) with at least the metal plate being designed in a substantially rectangular planar shape; as a consequence, even where vibration occurrable during ultrasonic welding is transferred to the metal plate, such vibration is hardly sent to the center of piezoelectric vibration plate enabling successful reduction of destructibility of piezoelectric ceramic layer.

When the metal plate is a terminal-cofunctional metal plate, wherein the transducer further comprises a lead terminal connected to a side corresponding to one of the electrodes formed on said piezoelectric ceramic layer which one is not in contact with the metal plate, and wherein said terminal-cofunctional metal plate and said lead terminal are externally taken out of the casing, it is possible to reduce the number of necessary parts or components of the piezoelectric electroacoustic transducer because of the fact that the metal plate is a dual-functional plate which may serve also as an associative lead terminal allowing lead terminals required for external connection during assembling of the piezoelectric electroacoustic transducer to be limited to a single lead terminal used for connection with an electrode as formed at the piezoelectric ceramic.

When first and second lead members are contacted with the metal plate and electrode respectively for external extension from the casing to the outside, it becomes possible by way of example to construct the first and second lead members by use of lead wires with flexibility as well as to constitute the first and second lead members using the metal plate. More specifically, it is possible to appropriately modify the materials for the first and second lead members in conformity with part to which the piezoelectric electroacoustic transducer is attached. It is thus possible to facilitate structural arrangement of the piezoelectric electroacoustic transducer in accordance with applications thereof.

What is claimed is:

1. A piezoelectric electroacoustic transducer comprising:

a piezoelectric vibration body having a substantially rectangular planar shape, the piezoetectric vibration body includes a substantially rectangular planar metal plate and a piezoelectric ceramic layer provided directly on the substantially rectangular planar metal plate such that the piezoelectric vibration body vibrates to produce acoustic waves; and a casing including at least two resin casing components joined to each other at a junction at which the at least two resin casing components are ultrasonically welded together, the piezoelectric vibration body being disposed in the casing.

2. The piezoelectric electroacoustic transducer according to claim 1, wherein said piezoelectric vibration body is sandwiched at peripheral portions thereof between the at least two resin components.

3. The piezoelectric electroacoustic transducer according to claim 1, wherein said at least two resin casing components include first and second resin casing components each having a substantially rectangular planar shape.

4. The piezoelectric electmoacoustic transducer according to claim 1, wherein electrodes are disposed on opposite major surfaces of the piezoelectric ceramic layer.

5. The piezoelectric electroacoustic transducer according to claim 3, wherein electrodes are disposed on opposite major surfaces of the piezoelectic ceramic layer.

6. The piezoelectric electroacoustic transducer according to claim 4, wherein said metal plate is a terminal-cofunctional metal plate, the transducer further comprises a lead terminal connected to a side corresponding to one of the electrodes located on said piezoelectric ceramic layer and said one of the electrodes does not contact the metal plate, and wherein said terminal-cofunctional metal plate and said lead terminal extend externally outside of the casing.

7. The piezoelectric electroacoustic transducer according to claim 5, wherein said metal plate is a terminal-cofunctional metal plate, the transducer further comprises a lead terminal connected to a side corresponding to one of the electrodes located on said piezoelectric ceramic layer said one of the electrodes does not contact the metal plate, and wherein said terminal-cofunctional metal plate and said lead terminal extend externally outside of the casing.

8. The piezoelectric electroacoustic transducer according to claim 4, further comprising first and second lead members respectively connected to said metal plate and said one of the electrodes which is not in contact with said metal plate, and said first and second lead members extend externally outside of the casing.

9. The piezoelectric electroacoustic transducer according to claim 5, further comprising first and second lead members respectively connected to said metal plate and said one of the electrodes which is not in contact with said metal plate, and said first and second lead members extend externally outside of the casing.

10. The piezoelectric electroacoustic transducer according to claim 3, wherein the first resin casing component includes a plurality of sound release holes formed therein.

11. The piezoelectric electroacoustic transducer according to claim 1, wherein the at least two resin casing components are made of synthetic resin materials having heat resistive characteristics.

12. The piezoelectric electroacoustic transducer according to claim 1, wherein at least one of the at least two resin casing components includes at least one cutaway portion.

13. The piezoelectric electroacoustic transducer according to claim 12, wherein the at least one cutaway portion is located in a side plane of the casing.

14. The piezoelectric electroacoustic transducer according to claim 12, wherein the at least one cutaway portion is located at an approximate center of side of the casing.

15. The piezoelectric electroacoustic transducer according to claim 12, wherein the at least one cutaway portion defines at least one projection which is arranged to support the piezoelectric vibration body.

16. The piezoelectric electroacoustic transducer according to claim 1, wherein each of the at least two resin casing components includes at least one cutaway portion.

17. The piezoelectric electroacoustic transducer according to claim 16, wherein the cutaway portions define projections which are arranged to support the piezoelectric vibration body.

18. The piezoelectric electroacoustic transducer according to claim 17, wherein the projections have different heights.

19. The piezoelectric electroacoustic transducer according to claim 1, wherein the piezoelectric vibration body includes outer end portions which are sandwiched between the at least two resin casing components such that a middle portion of the piezoelectric vibration body is disposed in a space defined between the sandwiched at least two resin casing components.

* * * * *